United States Patent [19]

Origuchi

[11] Patent Number: 4,506,801

[45] **Date of Patent: * Mar. 26, 1985**

[54] CONSTRUCTION FOR HOLDING PLASTIC FILM

[75] Inventor: Shingo Origuchi, Tokyo, Japan

[73] Assignee: Idemitsu Kosan Company Limited, Tokyo, Japan

[ * ] Notice: The portion of the term of this patent subsequent to Jun. 12, 2001 has been disclaimed.

[21] Appl. No.: 443,790

[22] Filed: Nov. 22, 1982

[30] Foreign Application Priority Data

Dec. 1, 1981 [JP] Japan ..... 56-194004

[51] Int. Cl.[3] ..... B65H 3/58

[52] U.S. Cl. ..... 221/26; 221/45; 206/390; 206/493; 206/494; 206/554; 242/55.53

[58] Field of Search ..... 221/26, 33, 45, 46, 221/55, 48, 63; 206/493, 449, 554, 326, 490, 494, 409, 390; 242/55.53

[56] References Cited

U.S. PATENT DOCUMENTS

| | | | |
|---|---|---|---|
| 374,399 | 12/1887 | Donovan | 221/26 |
| 445,857 | 2/1891 | Noee | 206/493 |
| 487,026 | 11/1892 | Cummings | 206/493 |
| 2,077,664 | 4/1937 | Beardsley | 221/26 X |
| 3,198,325 | 8/1965 | White | 206/493 |
| 3,221,929 | 12/1965 | Riebel | 221/48 X |
| 3,266,666 | 8/1966 | Nelson | 221/48 |
| 3,338,398 | 8/1967 | Altman, Jr. | 206/554 X |
| 3,380,579 | 4/1968 | Pinto | 206/493 |
| 4,305,503 | 12/1981 | Membrino | 206/554 |

FOREIGN PATENT DOCUMENTS

| | | | |
|---|---|---|---|
| 2408831 | 8/1975 | Fed. Rep. of Germany | 206/554 |
| 1218534 | 12/1959 | France | 206/449 |
| 54-52431 | 4/1979 | Japan . | |
| 1575072 | 9/1980 | United Kingdom . | |

*Primary Examiner*—Joseph J. Rolla
*Assistant Examiner*—Kevin P. Shaver
*Attorney, Agent, or Firm*—Flynn, Thiel, Boutell & Tanis

[57] ABSTRACT

A construction is disclosed for holding a bag-shaped or sheet-shaped continuous plastic film. In this holding construction, the plastic film is folded in a Z-shaped manner such that linear cuts formed in the continuous plastic film are accurately superposed on one another, and at least portions of insert members are inserted into the plastic film or the insert members are entirely inserted through the plastic film, so as to retain the plastics film in a bundled state. If one end portion of the film is drawn out, then a section of a predetermined length of the film is torn off along the linear cut or cuts by means of the insert members, and, when the section of the film is torn off, an end portion of the succeeding, i.e. second section of the film is automatically drawn out to a position corresponding to the position where the end portion of the first section of the film was initially positioned, through the action of connecting portions other than the linear cut or cuts, so that the construction, in which the plastic film can be easily used one section after another in the same manner as is the pop-up take-out method of tissue paper, can be obtained.

25 Claims, 19 Drawing Figures

CONSTRUCTION FOR HOLDING PLASTIC FILM

BACKGROUND OF THE INVENTION

1. Field of the Invention

This invention relates to a construction for holding a continuous plastic film partitioned into sections, each of which is formed into a bag or a sheet used as a trash bag or a sheet for wrapping, and particularly to such a construction, from which each section of the plastic film can be taken out in a predetermined bag or sheet shape.

2. Description of the Prior Art

Heretofore, there have been proposed various containers in which a multiplicity of bags made of plastics such as polyethylene are to be drawn out therefrom one after another when necessary. Nevertheless, such a bag made of plastic has a frictional resistance by far smaller than a piece of tissue paper, so that drawing out of one bag cannot bring the succeeding bag to a take-out opening by use of the Z-shaped fold-in type pop-up take-out method commonly used in the case of tissue paper, so that the latter method is not practicable for use with plastic bags. In view of the above, there has been proposed a construction, in which continuous plastic bags formed thereon with perforated lines are folded and superposed on one another, these folded bags are received in a container box, and, when a bag is to be drawn out, the aforesaid perforated line is brought into contact with an edge (corner) of the container box to thereby tear the bag off (Japanese Utility Model "Kokai"(Laid-Open) No. 52431/79). The above arrangement, however, is disadvantageous in that, when the bag is to be drawn out, the container box must be firmly held, and no such readiness in handling can be offered as with the pop-up take-out method applied to tissue paper.

Further, there has been proposed such a construction that plastic bags which have been separated from one another are superposed in a container, with each bag being partially overlapped onto the succeeding one, to thereby generate a force resisting drawing out of the bag in the direction of the draw-out. With the above arrangement, however, the bags could not always be drawn out one after another, but on the contrary, several bags tend to be drawn out together, whereby useless bags are accumulated to a large number, thus proving to be uneconomical.

To solve the above problems, the present applicant has proposed a construction for containing the plastic film in Japanese Patent "Kokai"(Laid-Open) No. 96948/82, in which a continuous plastic film is folded such that a linear cut or cuts provided at the respective folded sections are accurately superposed on one another. The plastic film is contained in a plastic film container such that insert members projectingly provided in the container are inserted through the linear cuts thus superposed, one end of the first section of film is drawn out to a predetermined length and then the film is cut away along the linear cut or cuts by means of the aforesaid insert members. When the film is cut away, one end of the succeeding, i.e. a second section of the film is automatically drawn out to a take-out opening through the action of connected portions other than the linear cut portions, thereby enabling the achievement of the readiness of the pop-up take-out method as applied to tissue paper and the reliable take-out of the bag-shaped or sheet-shaped film sections one after another.

However, in the thus proposed construction for containing the plastics film, the insert members to be inserted through the linear cuts of the film are directly affixed to the container, whereby it is difficult to manufacture the container and to automate the process of installing the plastics film, thus presenting the disadvantage that it is difficult to manufacture the container inexpensively.

Then, to improve the workability of the process of installing the film, the present applicant has proposed a construction for containing the plastic film in Japanese Patent "Kokai"(Laid-Open) No. 142872/82, in which an insert members to be inserted through the linear cuts in the plastics film are provided on a plate member provided separately of the container, whereby the work of mounting the insert members onto the plate member is facilitated and the work of fastening of the plastics film and installing the film in the container are automated. In addition, the inventions including these containing constructions as in the aforesaid Patent Kokai (Laid-Open) Nos. 96948/82 and 142872/82 correspond to U.S. Pat. No. 4,453,649.

By the thus proposed constructions for containing the plastic film, the workability of the process of installing the film has been improved to a considerable extent. In consequence, it has become possible to manufacture the container less expensively than before.

SUMMARY OF THE INVENTION

The present invention has as its object the provision of a construction for holding the plastic film, wherein, even in comparison with the thus proposed constructions for containing the plastic film, the construction for holding the plastic film can be further inexpensively manufactured and sections of the thus held plastic film can be reliably and easily taken out one section after another.

To achieve the above object, the present invention contemplates that a bag-shaped or sheet-shaped continuous plastic film is formed with at least one linear cut in a crosswise direction at a predetermined interval along each line perpendicular to the longitudinal direction of the plastic film, this plastic film is folded in a Z-shaped manner with the linear cuts superposed on one another, insert members are inserted or at least partially inserted through the thus superposed linear cuts, the folded plastic film is bundled by means of these insert members, and the separation of sections of the plastic film from one section after another and the holding of the folded state of the plastic film are made possible.

DETAILED DESCRIPTION OF THE PREFERRED EMBODIMENTS

Figure 1:
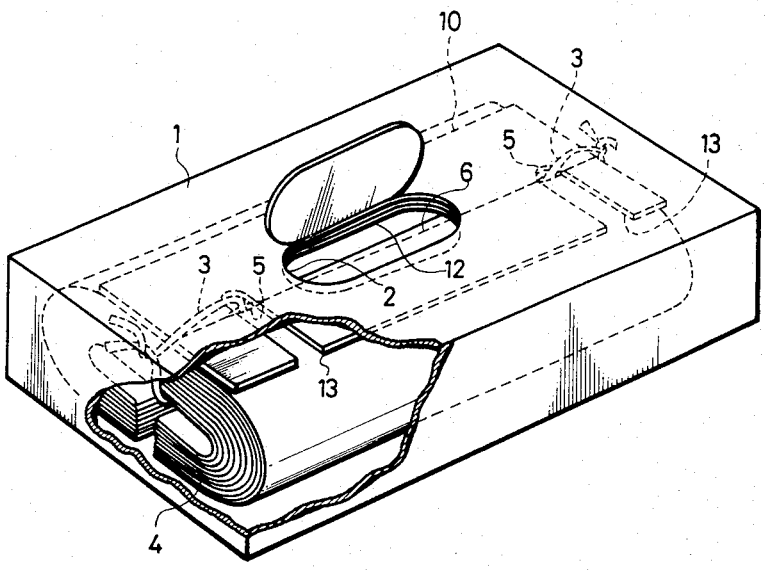
FIG. 1 is a partially cut-away perspective view showing a first embodiment of the holding construction for holding the plastic film according to the present invention.

FIG. 1 shows the first embodiment of the construction for holding the plastic film according to the present invention, in which a container 1 is made of paper board or the like and formed into a hollow rectangular parallelepiped, and an elliptical take-out opening 2 is formed in the center of the upper surface of this container 1. This take-out opening 2 is formed such that the center of the upper surface of the container 1 is opened by perforated lines provided along the aforesaid elliptical shape.

Figure 2:
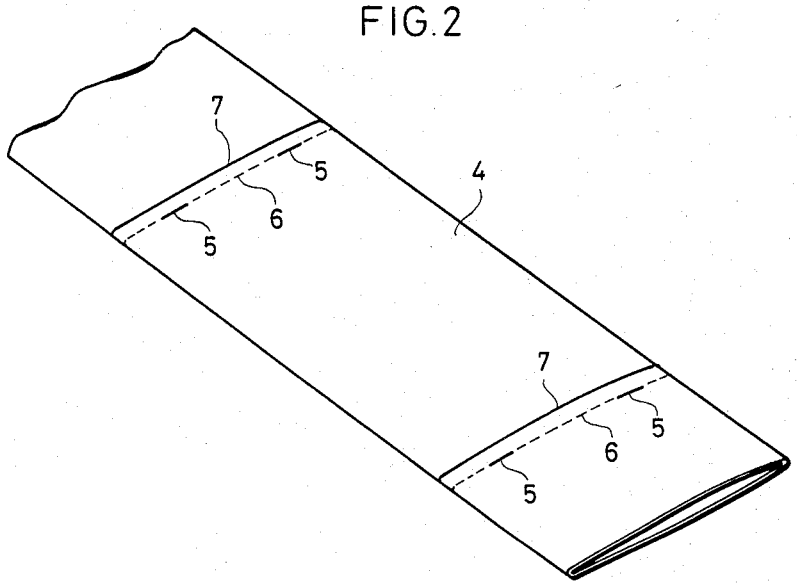
FIG. 2 is a perspective view of the essential portions showing one embodiment of the plastic film used in the embodiment shown in FIG. 1.

Contained in the container 1 is a plastic film folded in a Z-shaped manner. This plastic film 4, as shown in FIG. 2 for example, is of such an arrangement that a continuous tubular film formed by the tubular film process or the like is folded along lines perpendicular to the longitudinal direction of the plastic film to form a double wall portion. Linear cuts 5 penetrating through the double wall portion of the film 4 are formed in two lines at regular intervals in a crosswise direction at the intermediate portion of the folded portion of the continuous plastic film in the longitudinal direction of the film. Perforated lines 6 are formed along the lines of linear cuts over the entire length in the crosswise direction except at the linear cuts 5. The film 4 is connected in the longitudinal direction thereof at three portions in the crosswise direction, including at the central portion, by these portions of perforated lines 6. Furthermore, a heat seal portion 7 is formed by fusion bonding between the double walls adjacent and along the respective linear cuts 5 and perforated lines 6, and this heat seal portion 7 is formed over the entire length of the crosswise direction of the film 4 in parallel with the perforated lines 6, i.e., in a direction perpendicular to the longitudinal direction of the film 4.

Figure 3:
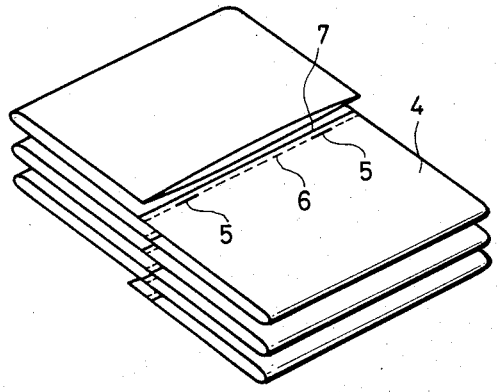
FIG. 3 is a perspective view showing the folded state of the plastic film shown in FIG. 2.

The above-described film 4, as shown in FIG. 3, is folded in a Z-shaped manner such that the respective linear cuts 5 are superposed on one another at the center. The thus folded, predetermined length, sections of the film 4 are, as shown in FIG. 1, contained in the container 1 in the state of being bent into C-shapes downwardly open viewed from the longitudinal side edges of the film 4.

Insert members 3 are inserted through the linear cuts 5 thus superposed of the plastic film 4 contained in the container 1, and the film 4 is bundled by the insert members 3 in a folded state.

The insert members 3 are each formed of a wire-reinforced plastic tape such as a flexible cord-shaped member of a predetermined length and, upon being inserted through the linear cuts 5 thus superposed, are bent at opposite ends thereof in the directions of opposite end edges, i.e., to the right and left in FIG. 1, and thereafter, engaged with each other, and then being twisted together.

A plate member 10 slightly smaller than the inside dimensions of the container 1 and capable of being readily put into and taken out of the container 1 is disposed inside a surface of the container 1 where the take-out opening is formed. This plate member 10 is made of a material such as paper or plastic, but is not restricted in material quality in particular.

Formed at the central portion of the plate member 10 is a take-out opening 12 of an elliptical shape corresponding to the take-out opening 2 of the container 1. At longitudinally opposite ends of this take-out opening 12 as seen in FIG. 1, relief grooves 13 opening at one side of the plate member 10 are formed corresponding to the inserted portions of the insert members 3 of the plastic film 4. The plate member 10 is bundled together with the plastic film 4 by means of the insert members 3 inserted through the relief grooves 13 and twisted together at the opposite end portions.

Description will hereunder be given of the manufacturing process of the present embodiment.

Figure 4:
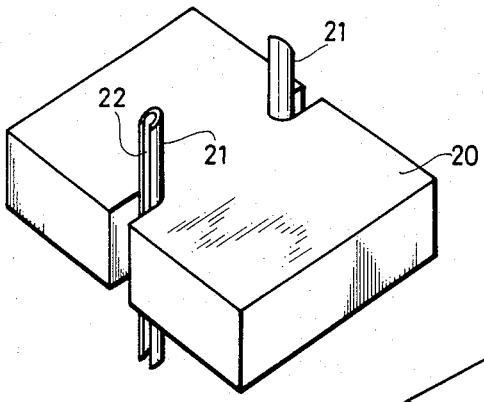
FIG. 4 is a perspective view of the essential portions showing an embodiment of a stock device used in manufacturing the embodiment shown in FIG. 1.

FIG. 4 shows the essential portions of the stock device used in the manufacture of the present embodiment. In this drawing, the top end face of a bearer 20 is formed into a flat plate shape. The bearer 20 is vertically displaceable. Pins 21 are upwardly projectingly provided at predetermined positions on the top end face of the bearer 20. The pins 21 are not vertically displaceable.

Each of the pins 21 is formed in the longitudinal direction thereof with an elongate groove 22 opening toward the outer periphery of the bearer 20. These elongate grooves 22 are adapted to receive therein the insert members 3.

The plastic film 4 is folded by a folding machine or the like, not shown, so that the film 4 can be folded by a predetermined width on the bearer 20 with the linear cuts 5 being accurately superposed with one another. In this case, the pins 21 are inserted through the linear cuts 5, and the bearer 20 gradually descends as the folding progresses.

Figure 5:
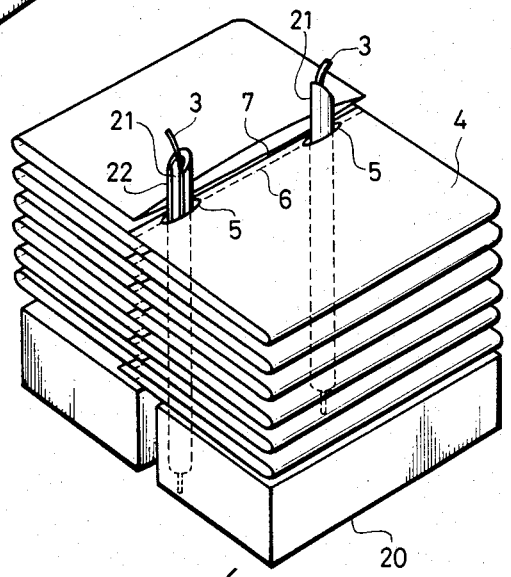
FIG. 5 is a perspective view showing the plastic film shown in FIG. 2, folded into the stock device shown in FIG. 4.

When the plastic film 4 of a predetermined quantity is folded on the bearer 20 as shown in FIG. 5, the insert members 3 are inserted through the elongate grooves 22 (or may be previously inserted therethrough), and subsequently, the opposite end portions of the insert members 3 are bent toward the outer periphery of the bearer 20, twisted together and engaged with each other, then the plastic film 4 is bundled by the insert members 3, and thereafter, the plastic film 4 is removed from the bearer 20, thus enabling the completion of the construction for holding the plastic film.

Figure 6:
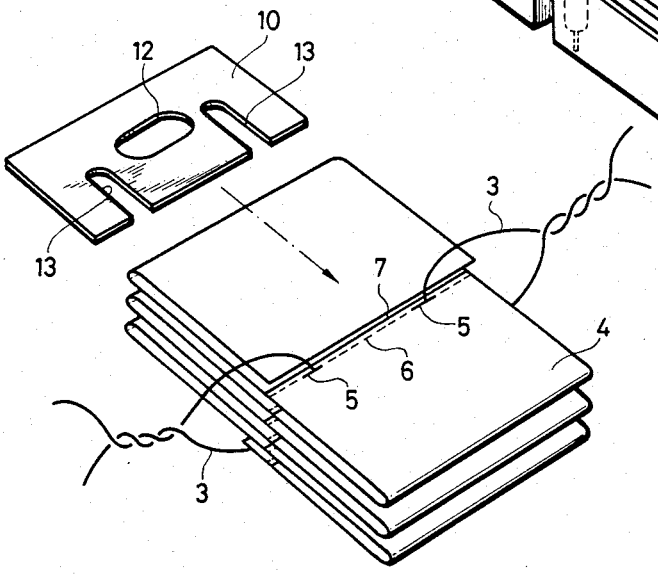
FIG. 6 is a perspective view showing the state where a plate member is secured to the plastic film shown in FIG. 2, folded by the stock device shown in FIG. 4.

If the plate member 10 is secured to the plastic film 4 in such a manner that the insert members 3 are inserted through the relief grooves 13 as shown in FIG. 6 after the plastic film 4 has been removed from the bearer 20 as described above, the plate member 10 and the plastic film 4 are bundled together by means of the insert member 3. The thus bundled article is installed in the container 1.

To take out a section of a predetermined length of the plastic film 4 to form a bag in the present embodiment, firstly, a forward end of the film 4 should be picked out of the take-out opening 2, and then, drawn out. When the film 4 folded and contained in the container 1 is drawn out by a length of bag, an end of the film 4, constituting a second bag subsequent to the first one, engages the insert members 3 because the insert members 3 are inserted through the linear cuts 5, with the result that the opposite end portions and the central portions of the film 4 other than the linear cuts 5, where the perforated lines 6 are formed, are torn off by a resisting force due to the above-described engagement. When torn off, the film 4 is drawn out of the take-out opening 2 formed in the center of the container 1. Hence, when the film 4 is drawn out by a length of bag, part of the central portion of the succeeding portion of the film 4, connected to the first portion through the perforated lines 6, is drawn out of the take-out opening 2 because the linear cuts 5 of the film 4 have widths to some extent and no resisting force is generated in the draw-out direction until the insert members 3 inserted through the linear cuts 5 reach the opposite end portions of the film 4 where connections are effected through the perforated lines 6. If the draw-out operation is continued in this condition, the opposite end portions of the film 4 connected to the succeeding section of the film 4 through the perforated lines 6 engage the insert members 3 as if the opposite end portions of the film 4 are wound around the insert member 3. At this time, tensile forces act on the opposite end portions of the film 4, whereby, firstly, the perforated lines 6 at the opposite end portions are cut. Thereafter, if the draw-out operation is further continued, a tensile force acts on the central portion of the film 4 due to a resisting force resulting from the engagement of the opposite end portions of the film 4 with the insert members 3, whereby the perforated line 6 at the central portion is cut. In consequence, part of the succeeding section of the film 4 should project out of the take-out opening 2 without fail.

With this embodiment as described above, the plastic film 4 can be reliably taken out in the same manner as in the pop-up take-out method of tissue paper, one section after another.

Moreover, the manufacturing process is very simple, so that the manufacturing efficiency can be improved to a considerable extent. Further, the insert members 3 are previously inserted through the film 4 continuously folded on the bearer 20, whereby a predetermined number of sections of the film 4 can be bundled by means of the insert members 3, so that the manufacturing process as a whole can be automated by the provision of a device of cutting the film by a predetermined number of sections and a device of twisting the insert members 3 together, thereby enabling the production at a reduced cost.

Furthermore, the outer dimensions of the plate member 10 are made slightly smaller than the inner dimensions of the container 1, so that, when the plate member 10 with the plastics film 4 engaged therewith is inserted into the container 1, the workability is high. Further, the dimensions of the plate member 10 and the container 1 are slightly different in dimensions from each other, whereby there is no possibility of a shift of the take-out opening 12 of the plate member 10 from the take-out opening 2 of the container 1 after the plate member 10 has been installed into the container 1. Moreover, the plate member 10 can be secured to the plastic film 4, which has been bundled by means of the insert members 3, whereby no particular reduction in the manufacturing efficiency is caused due to the provision of the plate member 10. Further, this plate member 10 may be replaced by one inserted into the plastics film 4 by every predetermined number of sections of the film 4 folded on the bearer 20, and thereafter, the predetermined number of sections of the plastic film 4 and the plate member 10 are bundled together by means of the insert members 3.

Figure 7:
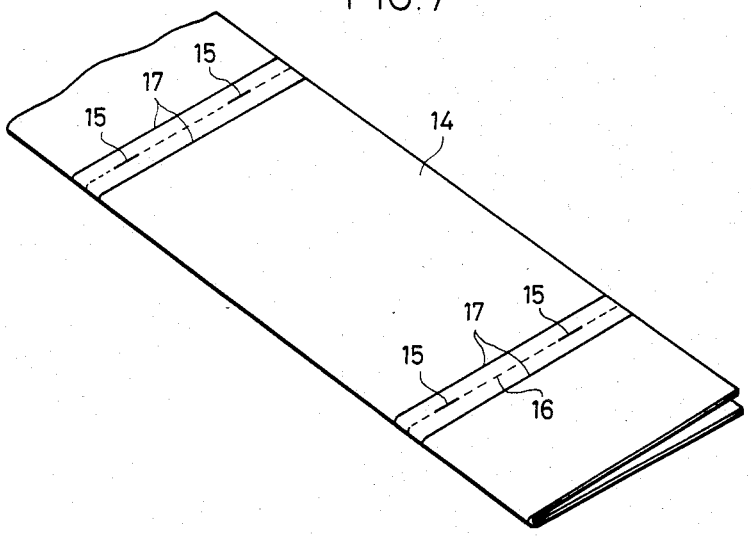
FIGS. 7 and 8 are perspective views of the essential portions showing other embodiments of the plastic film differing from each other according to the present invention.
Figure 8:
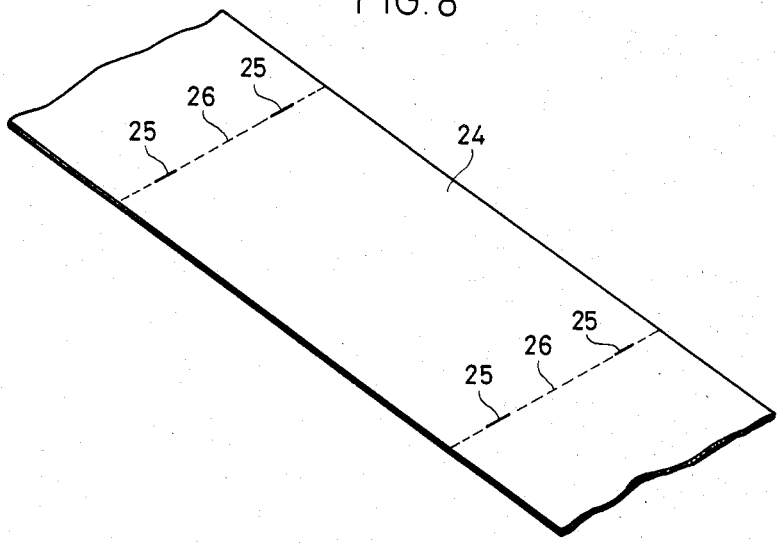

In working the invention, the plastic film 4 in the above-described embodiment may be replaced by a plastic film 14, a longitudinal side edge of which is opened as shown in FIG. 7 or a plastic film 24 formed of a single sheet as shown in FIG. 8. The plastic film 14 shown in FIG. 7 is provided with two linear cuts 15 disposed at regular intervals in the longitudinal direction thereof, perforated lines 16 are provided at a position incorporating the linear cuts 15, and heat seal portions 17 are provided at both sides of the perforated lines 16. Further, the plastic film 24 shown in FIG. 8 is provided with two linear cuts 25 disposed at regular intervals in the longitudinal direction thereof, and perforated lines 26 are provided at a position incorporating the linear cuts 25. The same operation as those described above can be performed by use of these films 14 and 24. The perforated lines 6, 16 or 26 need not necessarily be provided, but, the provision of those perforated lines can offer advantages that facilitate the tear-off operation. Further, the number of linear cuts 5, 15 or 25 need not be two, but, may be reduced to one disposed at the center of the film 4, 14 or 24 in the widthwise direction or shifted from the center in the widthwise direction toward either one of side edges of the film. In this case, if the linear cut 5, 15 or 25 is disposed in the center in the widthwise direction, then opposite end portions of the succeeding film 4, 14 or 24 are drawn out, and, if the linear cut 5, 15 or 25 is shifted from the center in the widthwise direction, then one end portion farther separated from the linear cut 5, 15 or 25 of the succeeding film 4, 14 or 24 is drawn out when the film 4, 14 or 24 is drawn out. When two linear cuts 5, 15 or 25 are present, if one of those linear cuts is disposed at an intermediate portion in the crosswise direction of the film 4, 14 or 24, then the other may be located to start from the side edge of the film 4, 14 or 24 with one portion thereof being cut open. However, when two linear cuts 5, 15 or 25 are provided at an intermediate portion in the crosswise direction of the film 4, 14 or 24 and the insert members 3 are inserted at opposite sides of the take-out opening, then there are presented advantages such that a resisting force present when the film 4, 14 or 24 is drawn through the connecting portions at opposite sides causes the succeeding section of the film 4, 14 or 24 to be reliably drawn out.

Figure 9:
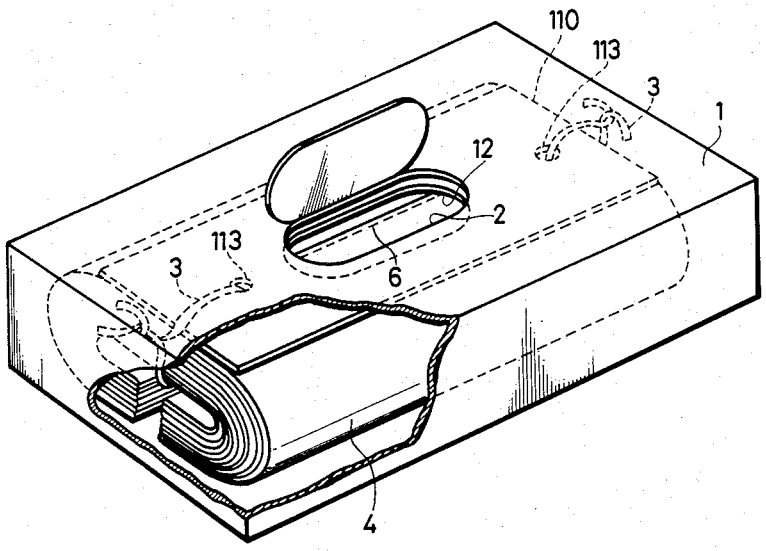
FIGS. 9 through 11 are perspective views, partially cut away, showing second through fourth embodiments.

In the above-described emboidment, the plate member 10 has relief grooves 13 opening at one side of the plate member 10, but, this specific form may be replaced by a plate member 110 in the second embodiment shown in FIG. 9, which has cylindrical insertion holes 113.

Figure 10:
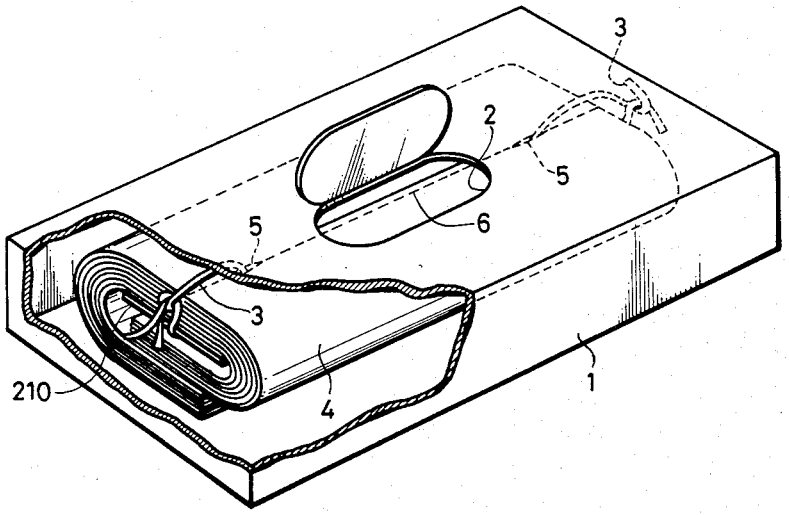
Figure 11:
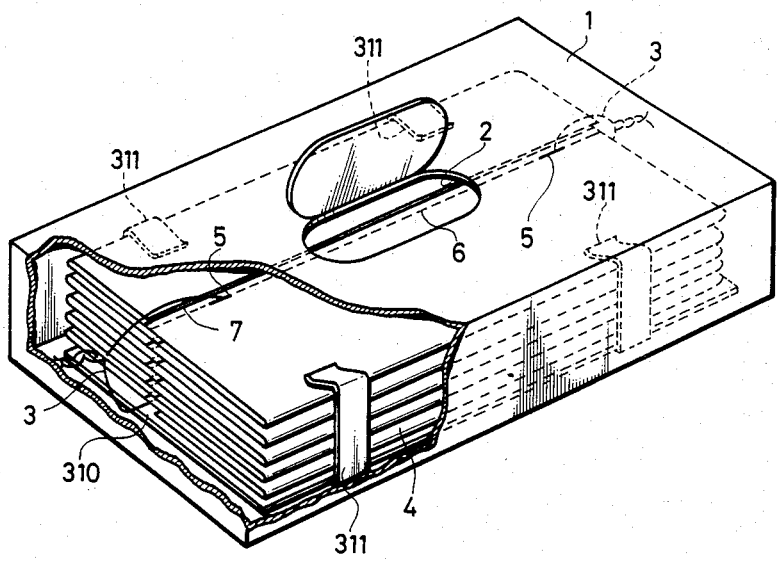

Furthermore, the plate member need not necessarily be one which is provided at the side of the take-out opening 2 of the container 1, but, may be one which is provided at a position opposite to the take-out opening 2 of the container 1, i.e. on the side of the bottom of the container 1 like a plate member 210 of the third embodiment shown in FIG. 10. Further, the plate member need not necessarily be one which is bundled together with the film by means of the insert members, but, may be one in which the plate member 310 is secured to the film 4 by means of substantially an inverted U-shaped retainers 311 formed separately of the insert members 3 as in the fourth embodiment shown in FIG. 11. In this case, a stage of bundling the film 4 by means of the insert members 3 can be separated from a stage of securing the plate member 310 to the film 4, and the plate members 310 are ones easily secured to the film 4, thus enabling to improve the manufacturing efficiency. In addition, the plate members 10, 110, 210 and 310 may not be provided at all.

Figure 12:
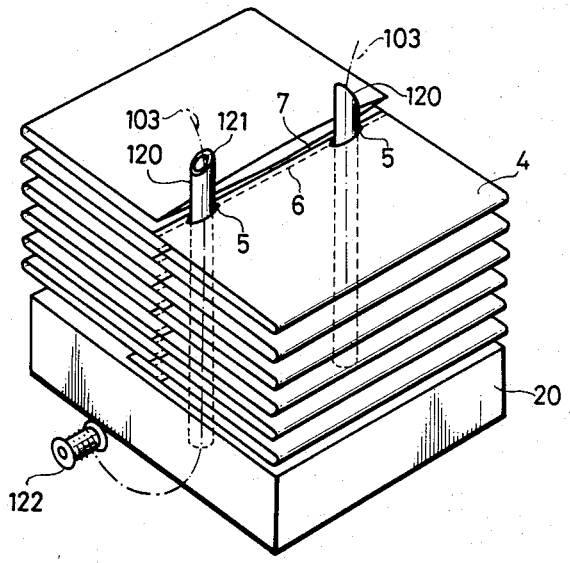
FIG. 12 is a perspective view showing the state where the plastic film shown in FIG. 2 is folded by an embodiment of the stock device other than the above.

Further, in the above-described embodiment, the insert members 3 are formed of flexible cord-shaped members such as wire-reinforced plastic tapes, however, need not necessarily be plastic or have a reinforcing core, but, may be flexible cord-shaped members having no core at all such as a simple vinyl cords, cotton strings or the like. In this case, as shown in FIG. 12, if pins 120 are formed into tubular forms and insert members 103 formed of cotton strings or the like are inserted through hollow portions 121 of the pins 120, then insert members 103 can be easily inserted through the linear cuts 5. In addition, reference numeral 122 in FIG. 12 designates a spool as being a supply source of the insert members 103.

Figure 13:
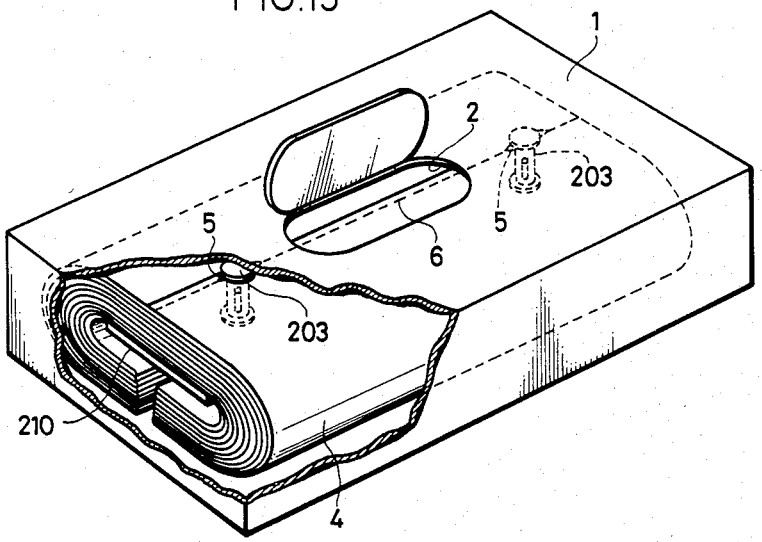
FIGS. 13 and 14 are perspective views, partially cut away, showing fifth and sixth embodiments, respectively.
Figure 14:
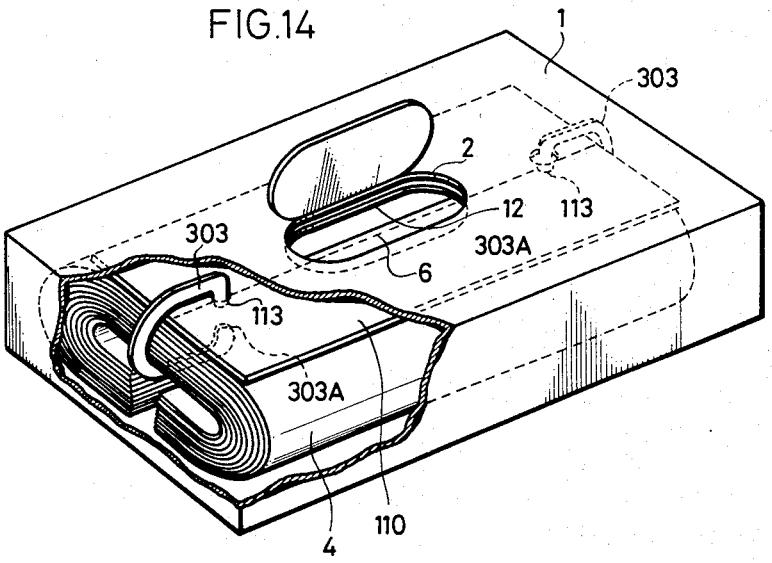

Furthermore, the insert members need not necessarily be formed of flexible cord-shaped members, but, may be rod-like members made of plastic or the like and formed into substantially spool-like forms provided at opposite ends thereof with comparatively large flanges like insert members 203 of the fifth embodiment shown in FIG. 13, or may be clips made of plastic, having rigidity and formed into substantially C-shapes like insert members 303 of the sixth embodiment shown in FIG. 14. In the latter case, fingers 303A formed at the side of an opening of the insert member 303 should be inserted through the linear cuts 5 of the film 4.

Further, the installed state of the plastic film 4 folded in the container 1 need not necessarily be the downwardly bent C-shape, but, may be an upwardly bent C-shape or any other shape, or may not be bent at all.

Figure 15:
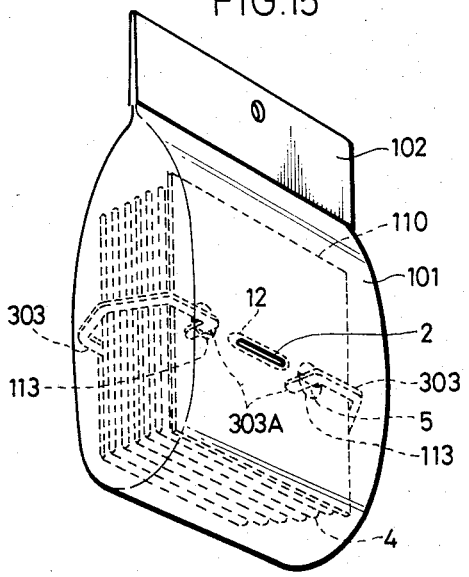
FIGS. 15 through 19 are perspective views showing seventh through eleventh embodiments, respectively.
Figure 16:
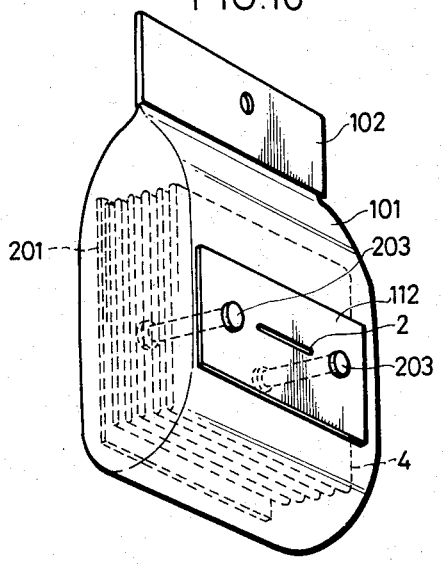
Figure 17:
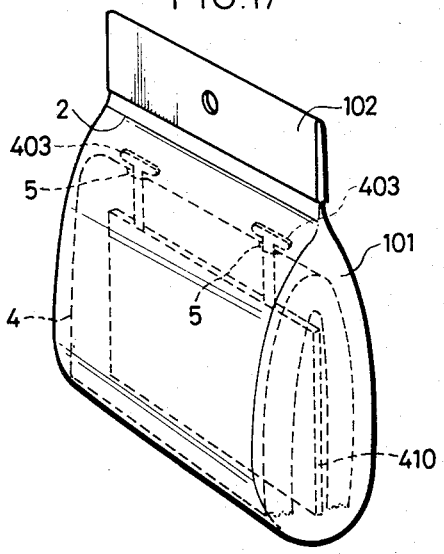

Furthermore, the container need not necessarily be the hollow parallelepiped, i.e. box shape, but, may be replaced by a plastic bag made of polyethylene or the like, which is very inexpensive as compared with the box-shaped one. More specifically, a container 101 as in the seventh through ninth embodiments shown in FIGS. 15 through 17, respectively, is formed of a transparent or opaque polyethylene bag and provided at one side edge thereof with a mount 102. Of these, the eighth embodiment shown in FIG. 16 is of such an arrangement that insert members 203 are secured to a container 101 from the outside. While, in the ninth embodiment shown in FIG. 17, the folded film 4 is further doubly folded, and the thus doubly folded film 4 is arranged to clamp a plate member 410, and substantially T-shaped insert members 403 provided at one side edge of the plate member 410 are inserted through the linear cuts 5 of the film 4. In addition, a reinforcing plate 112 may be provided around the take-out opening 2 of the container 101 as in the eighth embodiment. The mount 112 need not necessarily be provided in the seventh through ninth embodiments.

Figure 18:
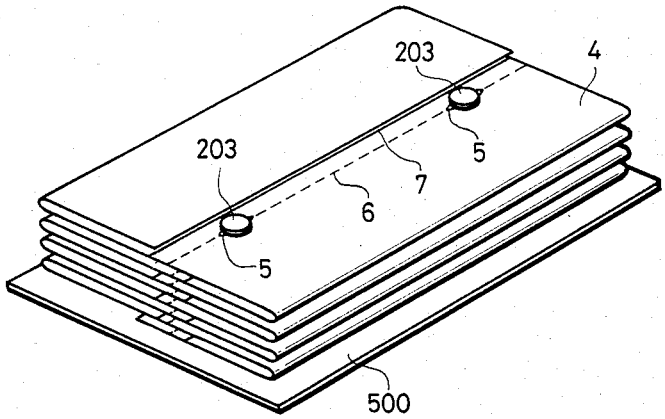
Figure 19:
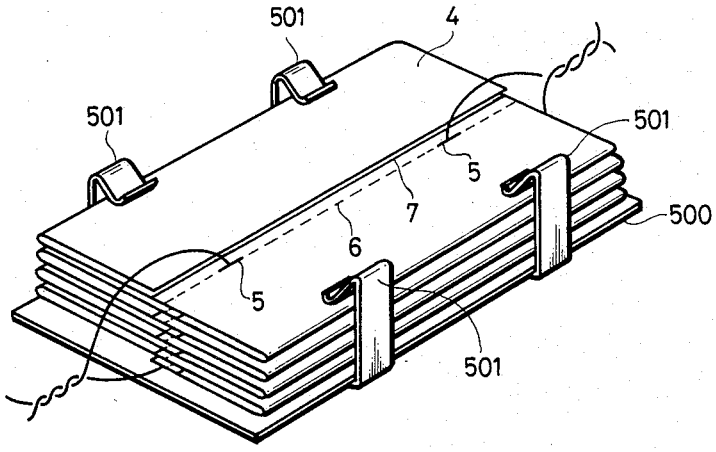

Further, the box-shaped or bag-shaped containers need not necessarily be provided. In short, it suffices to retain the folded plastic film. In consequence, the film 4 may be mounted on a plate member 500 functioning as a mount as in the tenth and eleventh embodiments shown in FIGS. 18 and 19. Of these, the tenth embodiment shown in FIG. 18 is of such an arrangement that the film 4 is secured to and retained on the plate member 500 by means of the insert members 203. While, in the eleventh embodiment shown in FIG. 19, the film 4 is secured to and retained on the plate member 500 by means of retainers 501 of substantially U-shape in cross section, which are formed separately of the insert members 3.

The present invention with the above-described arrangement can provide the holding construction which can be manufactured at a reduced cost, and in which the installed film can be reliably and easily taken out one section after another.

What is claimed is:

1. A plastic film dispenser comprising:

a hollow container having a take-out opening in a top wall thereof;

a continuous, elongated, strip of plastic film inside said container, said strip having transverse lines of perforation at regularly spaced intervals along its length whereby said strip is partitioned into a multiplicity of easily separable sections, said transverse lines of perforation each including two transversely spaced, elongated cuts, said cuts being arranged in two sets, the cuts of each set being parallel with each other and being aligned with each other in the lengthwise direction of said strip, said sets of cuts being equidistant from the respective side edges of said strip, said strip being folded back and forth upon itself to form a stack of superposed layers, wherein all of said lines of perforation are disposed substantially in vertical registry with each other substantially midway between the lateral edges of said stack of superposed layers and the cuts of each set are vertically superposed in registry with each other, said folded strip being disposed in said container so that an upper end of said continuous strip is disposed in close proximity to said opening in said container and can be readily drawn therethrough; and two insert members disposed in substantially fixed positions within said container at opposite ends of said opening and inserted through said sets of cuts, respectively, said folded strip thereby being retained in said container, said insert members having means for binding said folded, continuous plastic film in a bundle, said bundle being retained in said container, whereby when said upper end of said strip is drawn a sufficient distance out of said container, said film becomes taut between said end being drawn out and said insert members, and said film tears across the width thereof at the topmost one of said lines of preforation and one of said sections of said film is thereby drawn from said dispenser.

2. A construction for holding a plastic film, comprising:

a continuous elongated plastic film partitioned into a multiplicity of sections at predetermined regular intervals in the longitudinal direction of said film, said film being provided with a multiplicity of longitudinally spaced-apart perforated lines extending in the crosswise direction of said film and dividing said film into said multiplicity of sections which are separable from each other, at least one transversely extending linear cut in each of said perforated lines, said cut being colinear with and forming part of its associated perforated line, said film being folded back and forth upon itself in such a manner that said linear cuts are superposed on one another to form at least one set of linear cuts which are in registry with each other; and at least one insert member inserted through said set of superposed linear cuts, said insert member having means for binding said folded, continuous plastic film in a bundle.

3. A construction as claimed in claim 2, wherein two of said linear cuts are formed at two positions along each of said perforated lines, said positions being spaced apart from each other in the crosswise direction of said film such that two of said sets of linear cuts are formed, and two of said insert members being inserted through said two sets of superposed linear cuts, respectively.

4. A construction as claimed in claim 3, further comprising:

a container having a take-out opening, said folded plastic film being disposed in said container such that a free end of said film can be readily drawn from said take-out opening in said container; and a plate member bundled together with said folded film by said insert members, said insert members being projections formed on and extending from said plate member.

5. A construction as claimed in claim 4, wherein said projections comprise a pair of T-shaped members.

6. A construction as claimed in claim 4, wherein said projections comprise a pair of spools having flanges formed at opposite ends thereof.

7. A construction as claimed in claim 2, further comprising at least one plate member bundled together with said folded plastic film by means of said insert member.

8. A construction as claimed in claim 7, further comprising at least one retainer formed separately of said insert member for retaining said plastic film, said retainer being provided on said plate member.

9. A construction as claimed in claim 7, further comprising a container in which said plastic film is contained together with said plate member, said container having a take-out opening for said film.

10. A construction as claimed in claim 9, wherein said container is formed into a box shape.

11. A construction as claimed in claim 9, wherein said container is formed of a plastic bag.

12. A construction as claimed in claim 11, further comprising a reinforcing plate provided around the take-out opening of said container.

13. A construction for holding a plastic film, comprising:

a continuous elongated plastic film partitioned into a multiplicity of sections at predetermined regular intervals in the longitudinal direction of said film, said film being provided with a multiplicity of longitudinally spaced-apart perforated lines extending in the crosswise direction of said film and dividing said film into said multiplicity of sections which are separable from each other, at least one transversely extending linear cut in each of said perforated lines, said cut being colinear with and forming part of its associated perforated line, said film being folded back and forth upon itself in such a manner that said linear cuts are superposed on one another to form at least one set of linear cuts which are in registry with each other; and at least one insert member inserted through said set of superposed linear cuts for bundling said folded film, said insert member being formed of wire-reinforced plastic tape having a predetermined length, opposite ends of said plastic tape being twisted together and thereby secured to each other to one side of said bundled film, whereby said plastic tape extends in a direction intersecting the lengthwise direction of said film.

14. A construction as claimed in claim 13, further comprising a container in which said plastic film is contained, said container having a take-out opening for said plastic film.

15. A construction as claimed in claim 14, wherein said container is formed into a box shape.

16. A construction as claimed in claim 13, wherein two of said linear cuts are formed at two positions along each of said perforated lines, said positions being spaced apart from each other in the crosswise direction of said film such that two of said sets of linear cuts are formed, and two of said insert members are inserted through said two sets of superposed linear cuts, respectively.

17. A construction as claimed in claim 16, wherein said lengths of wire-reinforced plastic tape forming said insert members form loops, and said twisted ends of each of said loops of said tape are disposed on opposite lateral sides of said bundled, folded film.

18. A construction as claimed in claim 17, further comprising:

a container having a take-out opening, said folded plastic film being disposed in said container such that a free end of said film can be readily drawn from said take-out opening in said container; and a plate member bundled together with said folded film by said insert members, said plate member being disposed on top of said folded film, said plate member having an opening therein in alignment with said take-out opening of said container so that said free end of said film can be drawn through said opening in said plate member, and said plate member further having means whereby said insert members can extend through and over said plate member so as to bind said plate member to said folded film.

19. A construction as claimed in claim 16, further comprising a container in which said plastic film is contained, said container having a take-out opening.

20. A construction as claimed in claim 19, wherein said container is formed into a box shape.

21. A construction as claimed in claim 16, further comprising at least one plate member bundled together with said folded plastic film by means of said insert members.

22. A construction as claimed in claim 21, further comprising at least one retainer formed separately of said insert members, for retaining said plastic film, said retainer being provided on said plate member.

23. A construction as claimed in claim 21, wherein said plate member is formed with relief grooves opening at one edge of said plate member, into which grooves said insert members are inserted.

24. A construction as claimed in claim 23, further comprising a container in which said plastic film is contained together with said plate member, said container having a take-out opening for said plastic film.

25. A construction as claimed in claim 24, wherein said container is formed into a box shape.

* * * * *